US007124609B1

(12) United States Patent
Hermanson

(10) Patent No.: US 7,124,609 B1
(45) Date of Patent: Oct. 24, 2006

(54) SPIN FORMING OF HVAC DUCT REDUCERS

(76) Inventor: Jeffrey Allen Hermanson, 21129 Snag Island Dr., Sumner, WA (US) 98390

( * ) Notice: Subject to any disclaimer, the term of this patent is extended or adjusted under 35 U.S.C. 154(b) by 112 days.

(21) Appl. No.: 10/655,559

(22) Filed: Sep. 4, 2003

Related U.S. Application Data

(60) Provisional application No. 60/408,471, filed on Sep. 4, 2002.

(51) Int. Cl.
*B21D 5/00* (2006.01)

(52) U.S. Cl. ..... 72/82; 72/83

(58) Field of Classification Search ..... 72/82, 72/83, 84, 85, 115, 379.2; 29/890.15
See application file for complete search history.

(56) References Cited

U.S. PATENT DOCUMENTS 2,086,488 A * 7/1937 Batie ..... 72/39
3,072,086 A * 1/1963 Birchfield et al. ..... 72/83
3,258,833 A * 7/1966 Schuttler ..... 29/894.353
3,543,552 A * 12/1970 Howe, Sr. ..... 72/82
5,384,949 A * 1/1995 Wodrich et al. ..... 29/557
5,983,496 A * 11/1999 Hermanson ..... 29/890.15
6,289,706 B1 * 9/2001 Hermanson ..... 72/82
6,694,791 B1 * 2/2004 Johnson et al. ..... 72/91

FOREIGN PATENT DOCUMENTS

JP 63-309339 * 12/1988

* cited by examiner

*Primary Examiner*—Ed Tolan
(74) *Attorney, Agent, or Firm*—Christensen O'Connor Johnson Kindness PLLC

(57) ABSTRACT

Method of a spin forming conical fittings for HVAC systems from 10 to 26-gauge steel material. A flat pattern is cut, stamped or otherwise formed from flat sheet stock or roll stock. The pattern is rolled or otherwise formed into a frustoconical shape. The workpiece is engaged with a die, and the end portions of the workpiece are formed as the workpiece is spun to press the workpiece against the die. In this manner, a small diameter collar portion is formed at the smaller end of the conical connector and/or a larger diameter collar portion is formed at the larger diameter end of the conical connector. Also, a flange connector can be formed at the larger and/or smaller end portions of the conical connector using spin forming or a combination of spin forming and roll forming techniques.

12 Claims, 9 Drawing Sheets

SPIN FORMING OF HVAC DUCT REDUCERS

CROSS-REFERENCE TO RELATED APPLICATION

This application claims the benefit of U.S. Provisional Application No. 60/408,471, filed Sep. 4, 2002.

FIELD OF THE INVENTION

The present invention relates to conical fittings used in heating, ventilation and air conditioning (HVAC) ducting systems, and more particularly to the spin and roll forming of conical reducers, conical taps, wye fittings and similar conical fittings used in HVAC ducting.

BACKGROUND OF THE INVENTION

Conical reducers are commonly used in HVAC ducting to serve as a transition between a larger diameter duct and a smaller diameter duct. The conical reducer can be joined between an end of a larger size diameter or duct and the adjacent end of a smaller diameter duct. Also, conical fittings can be used to intersect a larger diameter duct in a direction transversely to the length of the larger diameter duct. For this purpose, conical taps and saddle taps are typically used. Further, wye fittings can be used to connect two smaller diameter lines to the end of a larger diameter line, with the two smaller diameter lines being angularly disposed relative to each other.

Such conical fittings typically have been formed from a flat pattern that is then rolled to form a conical shape and welded along a seam. Collar sections are then welded, riveted or otherwise attached to the smaller end portion of the conical fitting, and also sometimes to the larger end portion of the conical fitting. This is a slow, labor intensive process causing the conical fittings to be relatively expensive to manufacture.

Moreover, current manufacturing techniques limit the gauge of material used to form the conical reducers to about 22 gauge. It would be advantageous if thinner gauge material, perhaps down to 26 gauge, could be used for conical fittings thereby reducing the weight and cost of such fittings. The present invention addresses the foregoing shortcomings of existing methods of manufacturing conical fittings by incorporating spin forming techniques.

SUMMARY OF THE INVENTION

The present invention concerns methods of forming conical connectors for use in HVAC ducting. Such connectors may be manufactured by placing a conically shaped workpiece of thin gauge metallic material into a spin die, with the spin die having at least one cylindrical surface or shoulder. The conically shaped workpiece is spun about its longitudinal central axis and a work tool used to form the workpiece as it is spinning to conform the workpiece to the shape of the cylindrical surface of the spin die, thereby to form a collar portion at at least one end of the conical fitting. The spin die can be formed with two cylindrical surfaces thereby to form collar portions at each end of the conical fitting.

In accordance with a further aspect of the present invention as the workpiece is spinning, a forming tool is used to press the workpiece against the cylindrical surface of the die, thereby to match the shape of the workpiece directly to the shape of the die.

In accordance with a further aspect of the present invention, the spin die is positioned within the workpiece before the workpiece is formed.

In accordance with another aspect of the present invention, the workpiece is positioned within the spin die prior to the workpiece being formed.

In an additional aspect of the present invention, a mating flange is formed at at least one end portion of the conical connector. This is accomplished by expanding the end portion of the workpiece as the workpiece is being spun to form a generally annularly shaped mating flange that extends generally transversely to the longitudinal central axis of the workpiece.

As another aspect of the present invention, a hem section is formed from the outer perimeter portion of mating flange while the workpiece is spinning. This is accomplished by forming the outer perimeter portion of mating flange to extend away from the surface of the mating flange to position generally concentrically to the longitudinal axis of the workpiece.

As another aspect of the present invention, return flange is formed by turning a portion of a hem section located distally from the mating flange over on itself as the workpiece is rotating.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention relates to a method for spin forming conical reducers, conical taps, and other types of connectors, especially reducing connectors, used in HVAC ducting. The present invention can be used down to at least 26-gauge steel metal material, whereas prior art methods of forming conical reducers were limited to about 22-gauge steel metal material.

Figure 1:
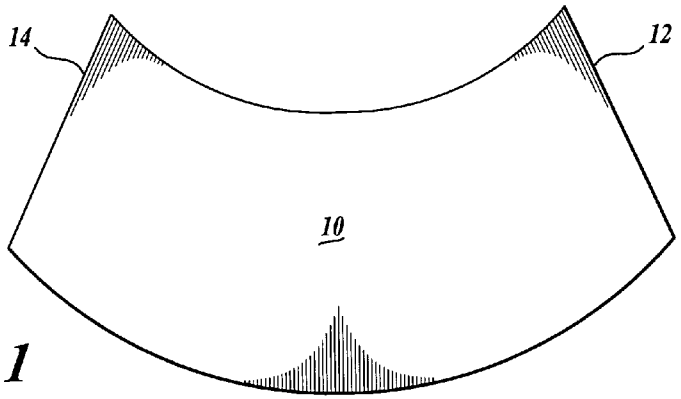
FIG. 1 is a depiction of the starting shape of the workpiece for a conical reducer manufactured by use of the present invention.

In accordance with the present invention, a workpiece flat 10, as shown in FIG. 1, is cut, stamped or otherwise formed from flat sheet stock or roll stock. The flat workpiece of FIG. 1 is rolled or otherwise formed into the frustoconical shape shown in FIG. 2 to define small diameter end 16 and larger diameter end 18. The mating edges 12 and 14 of workpiece 10 are welded or otherwise locked/connected together along a seam 20.

A forming die or jig 22 is placed within the interior of the frustoconical workpiece. The forming die may include a smaller, substantially constant diameter disk portion 24 having an outside diameter approximating the inside diameter of small end 16 and a larger, substantially constant diameter disk portion 26 somewhat smaller than the maximum interior diameter of the large end 18 of the frustoconical workpiece. The disk portions 24 and 26 define generally cylindrically shaped die surfaces that are concentric with the longitudinal, central axis 30 of the die. The disk portions 24 and 26 of the die 22 may be connected by a central hub 28 to form a unitary member. The die is held relative to the workpiece by any convenient method, such as by use of clamps, not shown. The die, 22, together with the workpiece 10, is adapted to being spun at relatively high speeds about longitudinal axis 30 (up to at least several hundred RPM), for example by coupling the die to a powered shaft or lathe spinning machine or other equipment. See for example the spinning machines disclosed in U.S. Pat. No. 5,983,496, incorporated herein by reference.

The forming die 22 can be designed in such a way to accommodate conical reducers of various sizes and of various reductions. In this regard, the disk portions 24 and 26 can be replaced with disk portions of other diameters as well as other thicknesses. Moreover, the central hub 28 can be of various lengths. In this matter, the forming die 22 can be very versatile and used to construct conical reducers of many different configurations.

A forming tool 32 is pressed against the outer diameter of workpiece 10 over the area of the small diameter disk portion 24 to form a small diameter collar portion 38. The same or a different work tool is placed over the larger diameter end portion of the workpiece over the location of the larger diameter disk 26 to form the workpiece against the disk, thereby to create a larger diameter, cylindrical collar section 40 at the end of the workpiece opposite the smaller diameter, cylindrical collar portion 38 and thereby arrive at a completed conical reducer 41. It can be appreciated that the cylindrical collar portions 38 and 40 are sized to engage within or over the adjacent end portions of circular ducting, not shown.

Although the present invention has been described in conjunction with the manufacturer of a conical reducer, the present invention may also be used to form other HVAC ducting components, for example, conical taps, conical tee reducers, die fittings, and other fittings in which a reduction in the diameter of the fitting occurs.

It will be appreciated that, rather than utilizing a die 22 that is positioned inside of the workpiece 10, a different die may be utilized that engages over the exterior of the conical-shaped workpiece. Such die may be of a first size to engage over the small end portion 16 of the workpiece and then a forming tool, such as tool 32, can be pressed against the inside diameter of the workpiece to force the workpiece outwardly against the exterior die to form a collar portion. Likewise, a larger diameter exterior die can be placed over the larger end portion 18 of the workpiece and then a forming tool used to press the workpiece outwardly against such die to form a collar portion. It will also be appreciated that an interior-type die may be used with one end portion of the workpiece and an exterior-type die used with the opposite end of the workpiece, so as to form the ends of the workpiece into substantially constant diameter collar portions.

Figure 6:
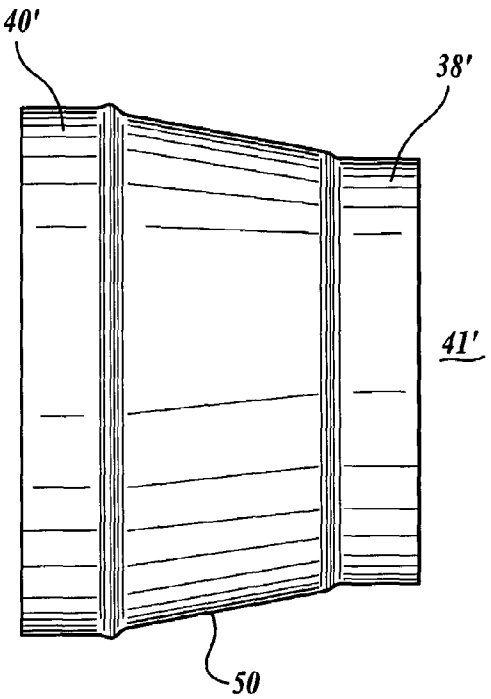
FIG. 6 is a completed conical reducer that has been spun formed using the die shown in FIG. 5.
Figure 5:
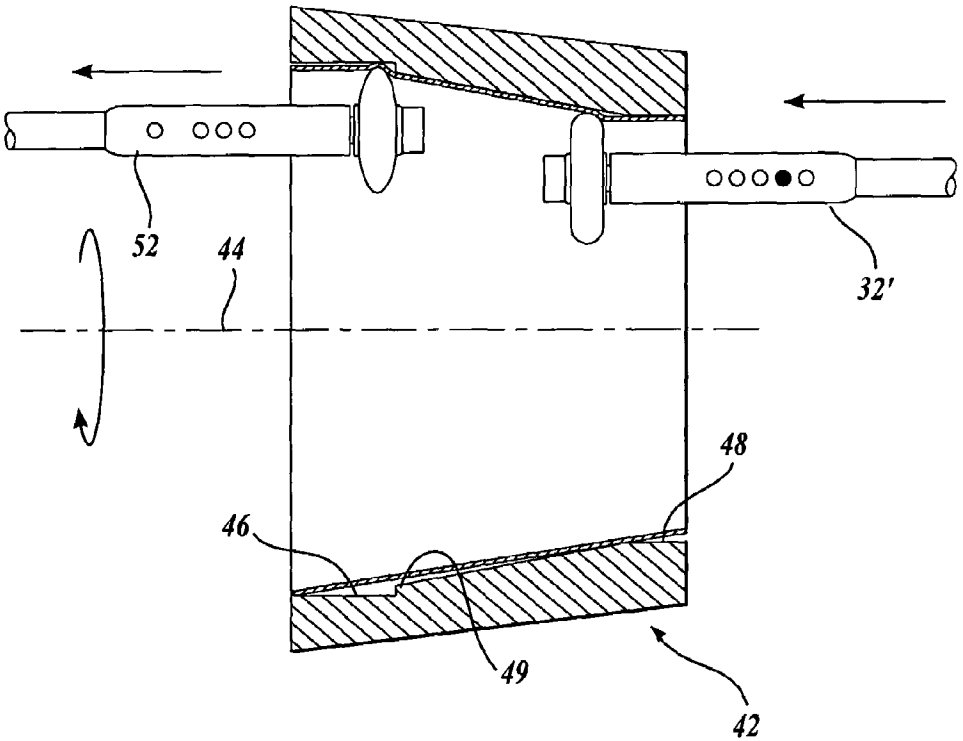
FIG. 5 is a cross-sectional view of a generally frustoconical workpiece shown as inserted within the interior of a forming die, with the lower portion of FIG. 5 showing the workpiece prior to being spun formed, and with the upper portion of FIG. 5 showing the workpiece being formed during spinning of the workpiece.

FIG. 5 shows an alternative embodiment of an exterior forming die 42 which is designed to be spun about a longitudinal axis 44. The interior of die 42 is shaped to correspond to the exterior of the finished conical reducer 41' shown in FIG. 6. To this end, the interior of the die 42 has a first interior cylindrical die surface 46 of substantially constant diameter and concentric with longitudinal axis 44. The interior of the die, at the opposite end thereof, has a second smaller diameter cylindrical die surface 48 which is of substantially constant diameter and concentric with longitudinal axis 44. The width of the die surfaces 46 and 48 correspond to the width of the cylindrical collar portions 38' and 40' shown in FIG. 6. Between the die surfaces 46 and 48, the interior 49 of the die 42 is tapered to match the taper of the central portion 50 of the conical reducer 41'.

Figure 2:
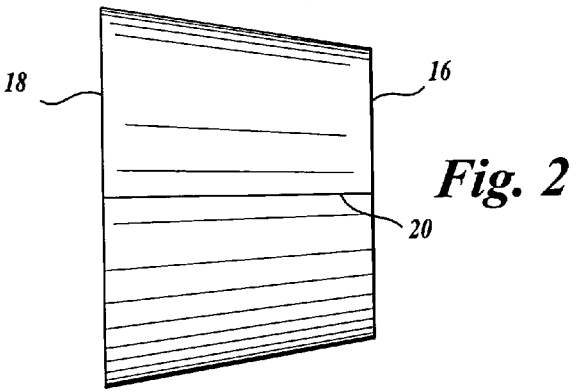
FIG. 2 is a side elevation depiction of the flat workpiece of FIG. 1 rolled or otherwise formed into a frustoconical shape.
Figure 3:
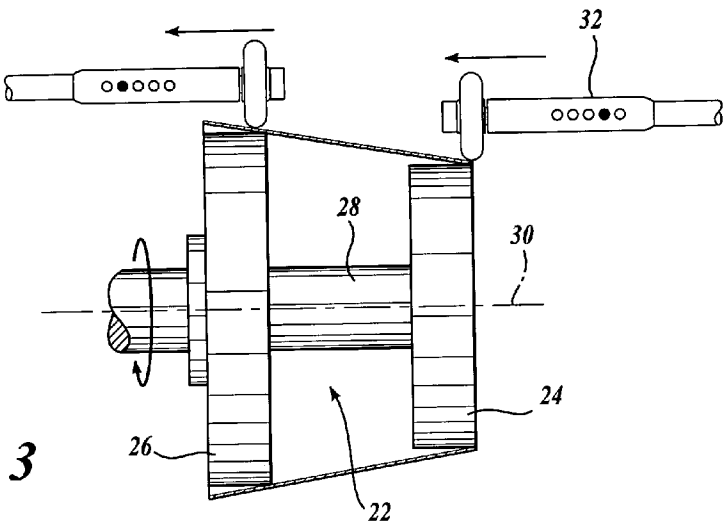
FIG. 3 is a cross-sectional view of the frustoconical workpiece of FIG. 2 with forming die or jig disposed within the interior of the conical workpiece prior to the workpiece being spun formed.
Figure 4:
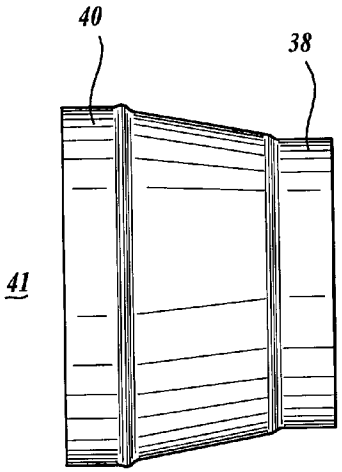
FIG. 4 is a completed conical reducer that has been spun formed.

To form the conical reducer 41' a workpiece, such as workpiece 10 shown in FIG. 2, is snugly placed within the interior of the die 42, to assume the position shown in the lower portion of FIG. 5. The workpiece may be securely held in place within the die by any convenient means. Thereafter, the die is spun about axis 44 and a forming tool 32' is positioned within the workpiece adjacent die surface 48 to force the adjacent portion of the workpiece against the surface 48 thereby to form collar portion 38'. A forming tool 52 is positioned within the interior of the workpiece and is pressed outwardly against the portion of the workpiece adjacent die surface 46 so as to force the workpiece against the die surface as the workpiece is rapidly spinning thereby to form the larger diameter collar section 40'. It will be appreciated that the forming tool 52 may have a sharper edge so as to be able to force the workpiece into the interior corner defined by the intersection of die surface 46 and central die portion 49. The same forming tool 52 may be used in place of forming tool 32' if it is desired to use the same forming tool at both ends of the workpiece. Thereafter, the formed conical reducer 41' may be simply slid off the die 42 in the left hand direction shown in FIG. 5. It will be appreciated that the completed conical reducer 41' can be substantially the same as the conical reducer 41 shown in FIG. 4.

The conical reducers 41 and 41' can be engaged within or over the adjacent end portions of circular ducting, not shown. Alternatively, the conical reducers may be further formed to create a flange connector at one or both of its ends that complies to the T24 or other flange profile of the Sheet Metal and Air Conditioning Contractors National Association (SMACNA).

Figure 9:
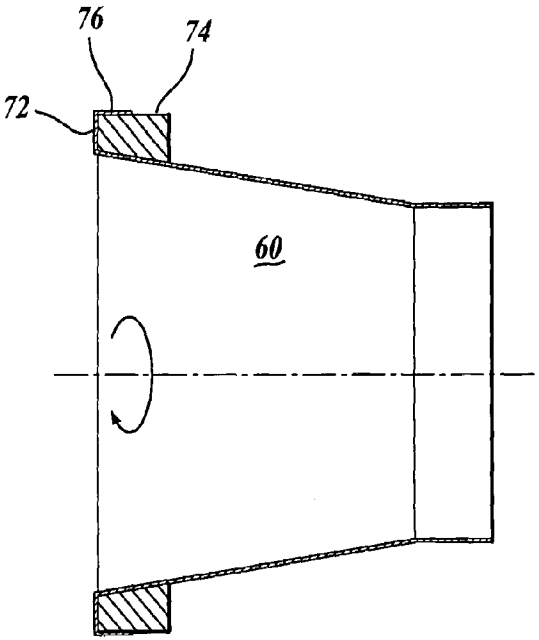
FIG. 9 shows the workpiece of FIG. 8, further formed to create a hem portion against exterior surface of the collar die.
Figure 8:
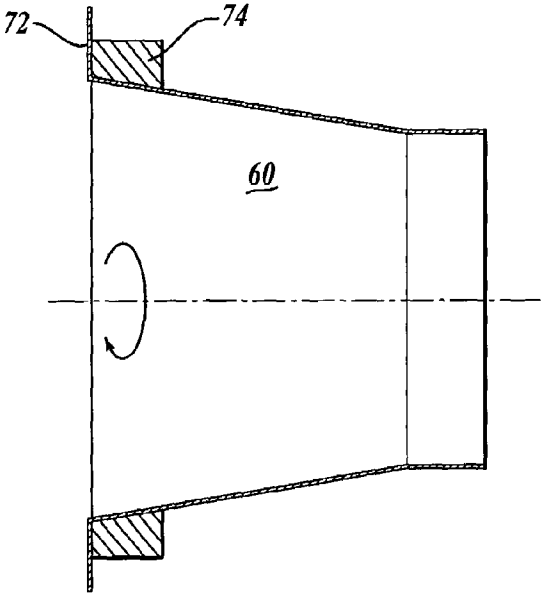
FIG. 8 illustrates the workpiece of FIG. 7, as partially formed to create a mating flange that extends transversely to the longitudinal axis of the workpiece.
Figure 7:
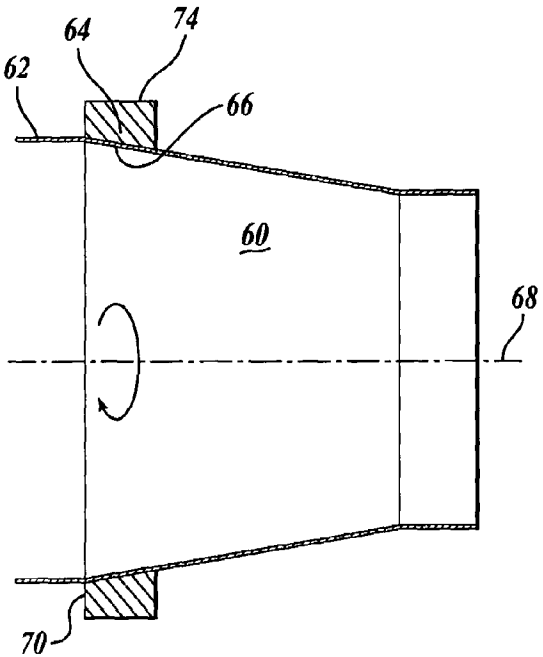
FIG. 7 is a workpiece having spun formed collars as engaged with a collar die used in conjunction with forming a flange connector at the larger end portion of the conical fitting.
Figure 10:
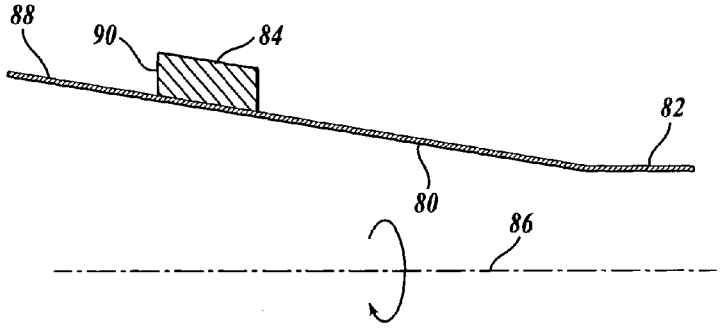
FIG. 10 illustrates a further embodiment of the present invention wherein a conical connector formed with a collar section at its smaller end portion is engaged with a collar die at its larger end portion to form a flange connector thereat.

One method of forming a flange connector to a conical reducer is shown in FIGS. 7, 8 and 9. The workpiece 60 is formed with a collar portion 62 at the larger diameter end thereof using one of the methods described previously. The workpiece is placed within a collar die 64 which is positioned along the conical portion 66 of the workpiece 60 adjacent the collar portion 62. The collar die is adapted to be spun about longitudinal axis 68 by any convenient means. The collar portion 62 may be formed against the end surface 70 of the collar die using various techniques, including those described in U.S. Pat. Nos. 5,983,496 and/or 6,289,706 so that the collar portion is worked into the orientation shown in FIG. 8, thereby to create a mating flange 72.

One example of how the collar portion 62 may be formed from the position shown in FIG. 7 to position shown in FIG. 8 is through the use of a forming tool similar to tools 32 or 52'. That same tool can then be applied against the portion of the mating flange 72 that extends beyond the diameter of the collar die 64 to bend the outer perimeter portion of the mating flange over against the exterior surface 74 of the collar die to form a hem portion 76, shown in FIG. 9. Thereafter, the collar die may be removed from the formed workpiece by sliding the collar die in the right-hand direction, shown in FIG. 9 relative to the workpiece.

Figure 11:
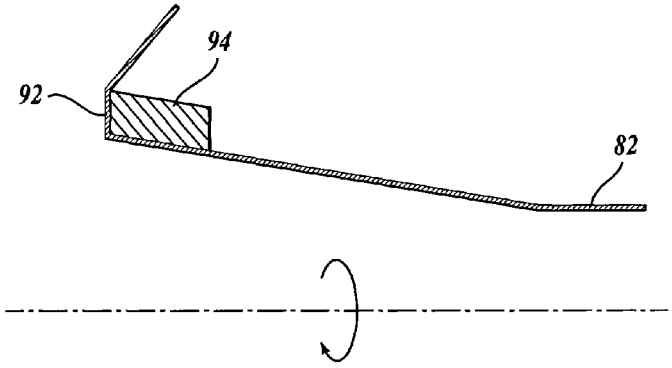
FIG. 11 shows the workpiece of FIG. 10 wherein a mating flange has been formed against the adjacent end portion of the collar die and with the outer perimeter portion of the mating flange turned partially down in the direction away from the mating flange.
Figure 12:
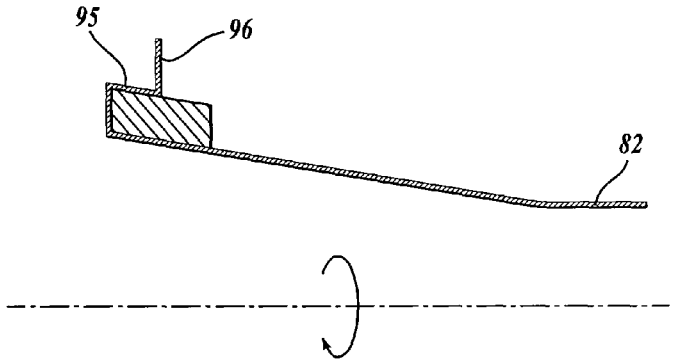
FIG. 12 shows the workpiece of FIG. 11, further formed with a hem section bearing against the outer surface of the collar die and with a return section extending transversely from the hem section.
Figure 13:
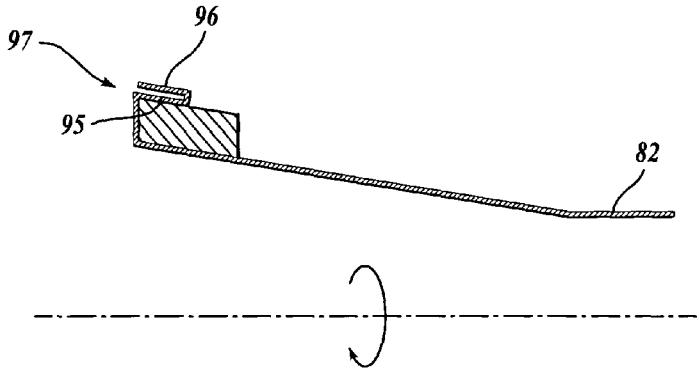
FIG. 13 shows the workpiece of FIG. 12, wherein the return portion has been pressed downwardly against the outer surface of the hem.
Figure 14:
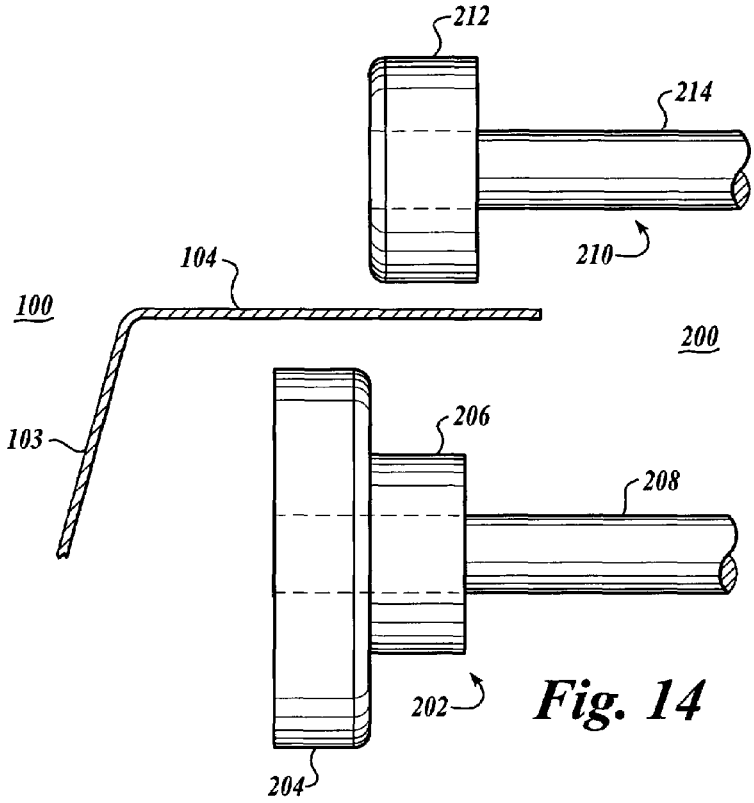
FIGS. 14, 15, 16, 17, 18 and 19 illustrate an alternative method of forming a flange connector at the end of the conical fitting of the present invention.

FIGS. 10, 11, 12 and 13 illustrate a further embodiment of the present invention wherein a flange connector is formed at one end of a workpiece 80 without a collar section first being formed in the conical reducer workpiece. FIGS. 10–13 correspond to generally the top portion of FIGS. 7, 8 and 9. As shown in FIGS. 10–13, the workpiece 80 includes a collar portion 82 formed at the smaller diameter end of the conical reducer to form the connector flange. A collar die 84 is placed over the workpiece 80 adjacent the larger diameter end of the workpiece. The workpiece is snugly held in engagement with the collar die by any convenient means. The collar die is spun about longitudinal axis 86 of the workpiece in the manner described above with respect to other embodiments of the present invention. A forming tool, which can be similar to tools 32 and 52, described above, may be utilized to form the portion 88 of the workpiece 80 that extends beyond the collar die 84. As shown in FIG. 11, the extending workpiece portion 88 is first pressed against the adjacent end 90 of the collar die to form a mating flange 92. The portion of the mating flange 92 that extends radially beyond the collar die is then folded over toward the outer surface 94 of the collar die. The workpiece is further formed to create a hem portion 95 and a further portion 96 that is folded over the hem portion to form a return portion, as shown in FIG. 13. It will be appreciated that the completed connector 97 can be used to connect the conical reducer to a T-24 or other profile flanged ring installed at the end of an adjacent duct or fitting.

Also, rather than forming the connector 97 at the larger end of the workpiece 80, a similar connector can be formed at the smaller diameter end of the workpiece using techniques similar to that described.

FIGS. 14–19 illustrate an alternative to the foregoing described methods for producing a flanged connector for a conical reducer 100. In this alternative method, an exterior mating flange 104 can be spin formed as described above. Thereafter, the hem section 105 can be formed by a first roller set 200 consisting of a first roller assembly 202 composed of a major diameter roller 204 and a side-by-side smaller diameter roller 206, both mounted on a rotatable shaft 208. The first roller set 200 also includes a second roller assembly 210 consisting of a roller 212 mounted on a rotatable shaft 214. The rotatable roller shafts 208 and 214 may be moved towards and away from each other in a substantially parallel orientation in a well-known manner. When the shafts are moved toward each other, the roller 212, positioned at the side of roller 204, forms the exterior and interior hem section 105, by capturing the hem section between the adjacent face sections of the rollers 204 and 212. In addition, a precursor to the return flange 106 may be formed between the outer diameter of roller 212 and the outer diameter of roller 206. See FIG. 15 wherein a hem section 105 extends substantially laterally and optionally perpendicular to a mating flange 104 and the precursor to the return flange 106 extends substantially perpendicular to the adjacent end of the hem section.

Figure 15:
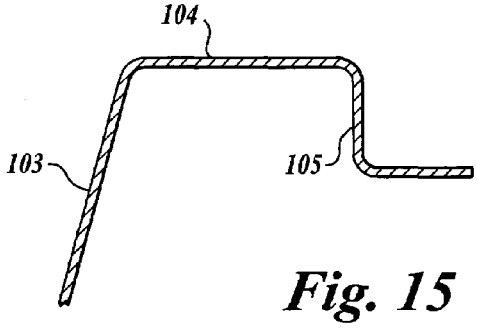
Figure 16:
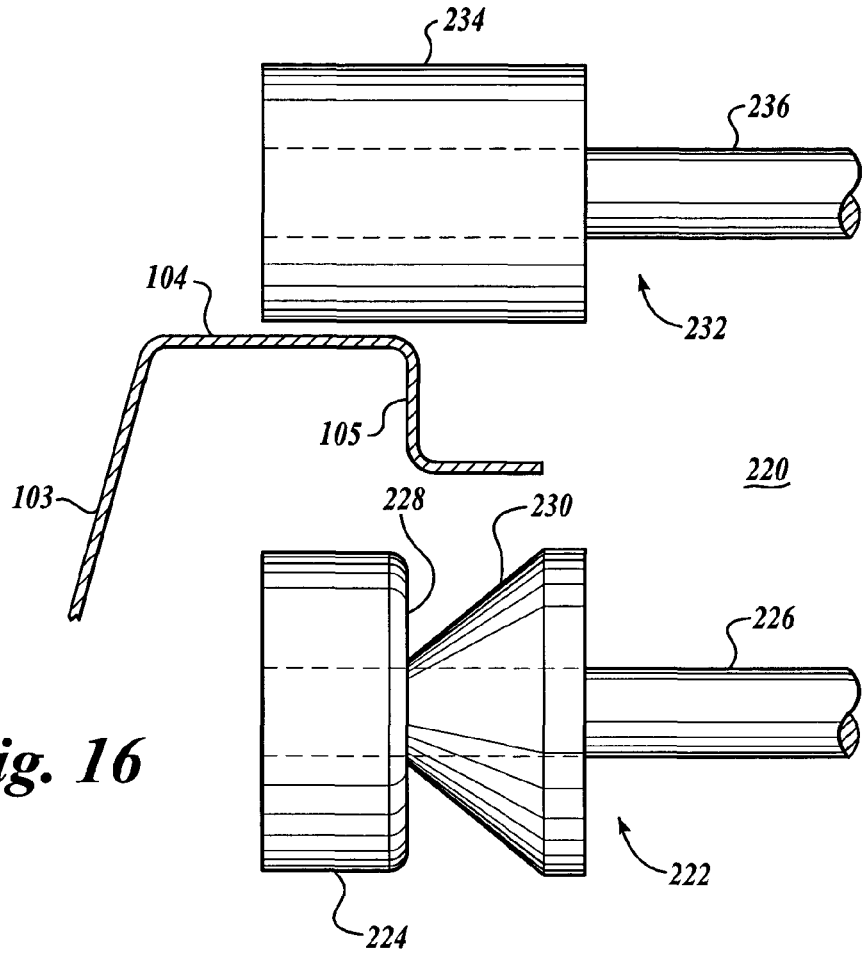

The partially formed Flanged Ring 100 of FIG. 15 may be placed in a roller set 220 of FIG. 16 for further processing. The roller set 220 includes a die roller assembly 222 composed of a die roller 224 mounted on a rotatable shaft 226. The die roller 224 may have a groove formed around its outer perimeter in the shape of a half "V" composed of a vertical face 228 and a diagonal face 230. The roller set 222 may include a second roller assembly 232 composed of a cylindrical roller 234 mounted on a rotatable shaft 236. The roller assemblies 224 and 232 are capable of moving towards and away from each other while the rotatable shafts 226 and 236 remain substantially parallel to each other. As shown in FIG. 16, the partially formed flanged connector 100 from FIG. 15 is positioned relative to roller 224 so that hem section 105 is adjacent vertical face 228 of roller 224. Thereafter, the roller sets 222 and 232 may be moved towards each other as the rollers 224 and 234 rotate relative to each other thereby causing the return flange section 106 to assume the orientation of roller face 230 relative to roller face 228, as shown in FIG. 17.

Figure 17:
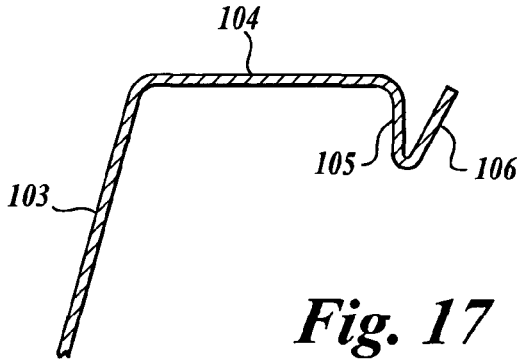
Figure 18:
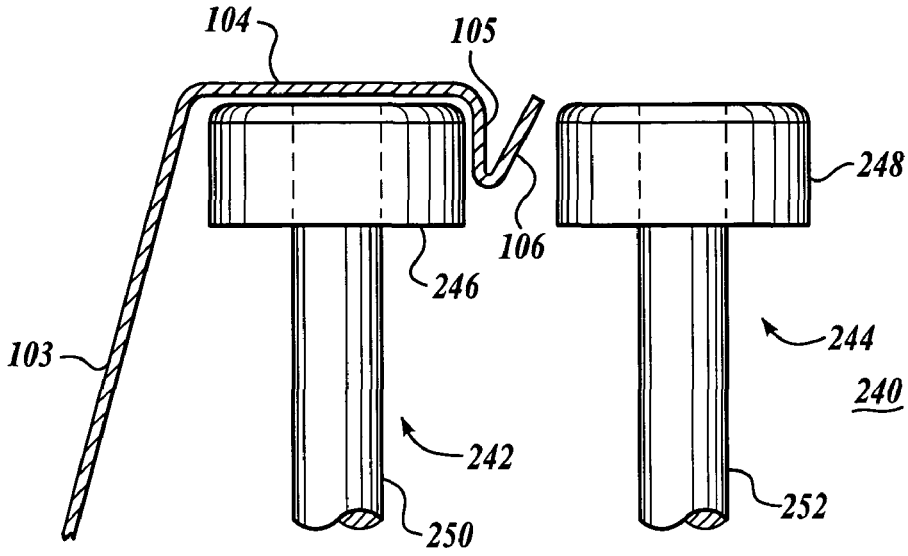
Figure 19:
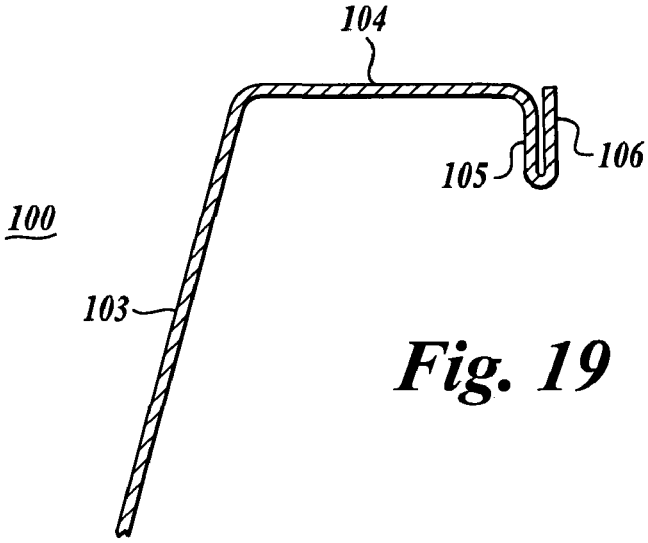
Figure 20:
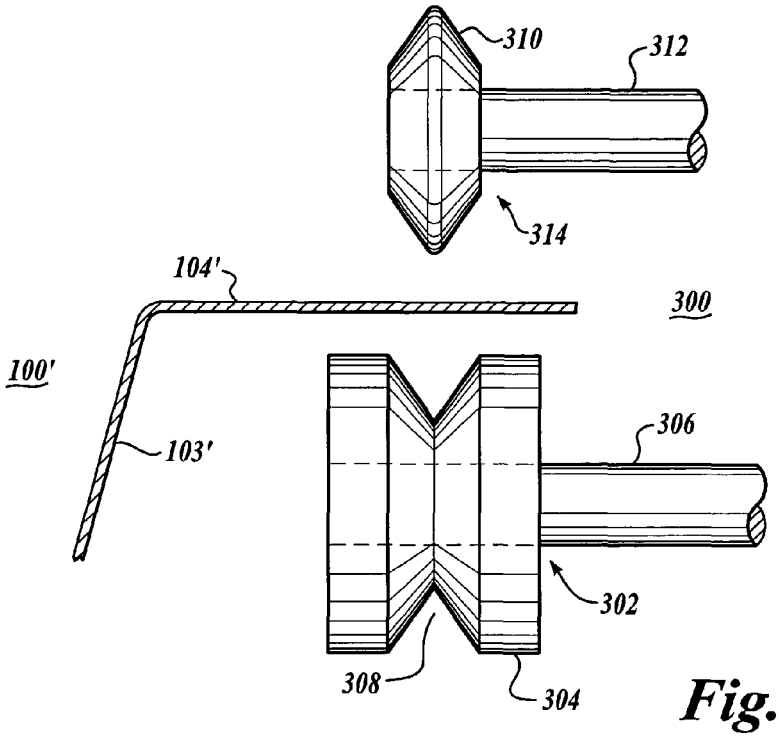
FIGS. 20, 21, 22 and 23 illustrate a further alternative method of forming the present invention.

Thereafter, the flanged connector in the configuration of FIG. 17 may be further formed by roller set 240 shown in FIG. 18. Roller set 240 consists of a pair of roller assemblies 242 and 244 each composed of a roller 246 and 248 carried by a corresponding rotatable shaft 250 and 252. As shown in FIG. 18, the hem section 105 and the partially formed return flange 106 may be placed between the two rollers 246 and 248 and then the two rollers are moved relatively towards each other while rotating, thereby to pinch the hem section and return flange therebetween so that the return flange closely overlies the hem section and thereby completing the formation of the flanged connector 100', as shown in FIG. 19.

Figure 21:
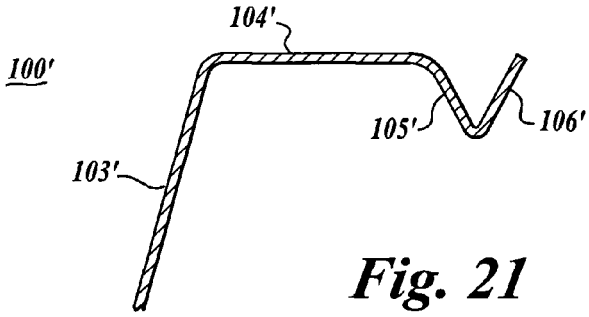

FIGS. 20–23 illustrate another method of forming a flanged connector 100' for a conical reducer in accordance with the present invention. As illustrated, the exterior mating flange 104' of the flanged connector 100' may be formed using a spin forming method, such as described above. Thereafter, the outer marginal portion of the mating flange may be placed in roller set 300 to partially form each hem section 105' and return flange 106', as shown in FIG. 21. The roller set 300 may include a first roller assembly 302 consisting of a roller die 304 mounted on the rotatable shaft 306. A "V" shaped groove 308 extends around the circumference of the roller die 304 to match the outer perimeter profile of a roller die 310 mounted on rotatable shaft 312 of a roller assembly 314. The roller assemblies 302 and 314 are capable of moving towards and away from each other while their respective shafts 306 and 302 rotate and maintain an orientation substantially parallel to each other. As a consequence, when the outer marginal portion of the exterior mating flange 104' is placed in alignment with groove 308 and then the roller dies 304 and 310 rollably engage with each other they cooperatively form hem section 105' and return flange 106' in the orientation shown in FIG. 21.

Figure 22:
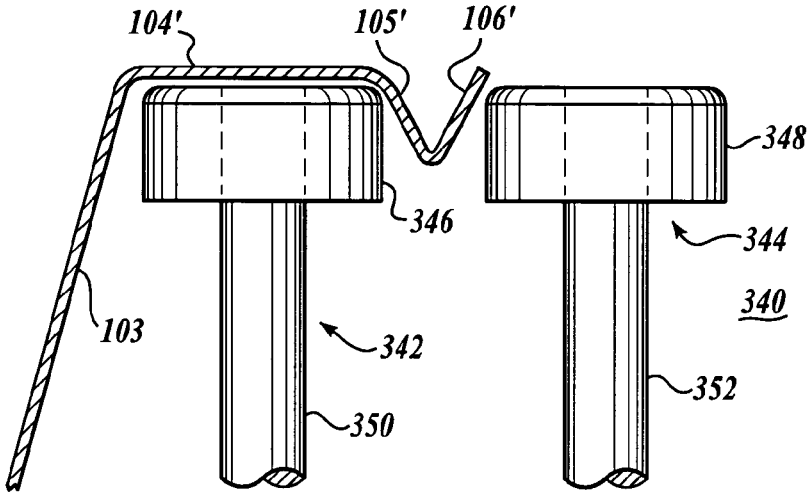
Figure 23:
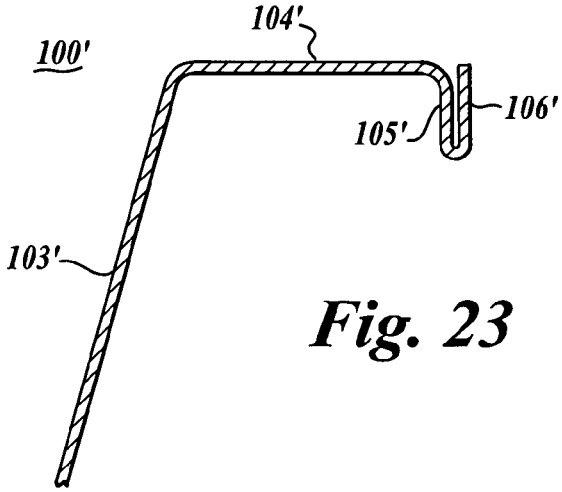

Thereafter, the partially formed flanged connector shown in FIG. 21 may be further worked by roller set 340 shown in FIG. 22. The roller set 340 corresponds to the roller set 240 shown in FIG. 18, with the description set forth above with respect to FIG. 18 applying to FIG. 22, but with the part numbers increased by 100. Thus, such description will not be repeated. The result of roller set 340 is a finished flanged connector 100' as shown in FIG. 23.

It will be appreciated that other combinations of roller sets could be utilized to form the hem section and return flange of the flanged connector, other than as illustrated above in FIGS. 14–23. Although use of such rolling techniques may not be as efficient as spin forming the entire flanged connector in the manner described above, utilizing rolling processes may enable the flange ring to be manufactured with less expensive tooling or with tooling already on hand as opposed to requiring extensive spin form tooling.

While the preferred embodiment of the invention has been illustrated and described, it will be appreciated that various changes can be made therein without departing from the spirit and scope of the invention.

The invention claimed is:

1. The method of making conical connectors that are open at both ends for use in HVAC ducting, comprising:

placing a conically shaped workpiece that is open at both ends and is of 22–26 gauge metallic material into engagement with a spin die, the spin die having at least one generally cylindrically shaped surface portion;

spinning the conically shaped workpiece that is open at both ends about its longitudinal central axis; and forming the conically shaped workpiece that is open at both ends as the workpiece is spinning to conform either one or both longitudinal ends of the workpiece to the shape of the spin die generally cylindrically shaped surface portion.

2. The method according to claim 1, wherein the spin die has two generally cylindrically shaped concentric surfaces and the workpiece that is open at both ends is formed during spinning of the workpiece to conform either one or both longitudinal ends of the workpiece to the shape of both generally cylindrically shaped concentric surfaces.

3. The method according to claim 2, wherein the generally cylindrically shaped surfaces have different diameters.

4. The method according to claim 2, wherein the spin die is positioned within the workpiece.

5. The method according to claim 2, wherein the workpiece is positioned within the spin die.

6. The method according to claim 2, wherein the workpiece is formed against the concentric surfaces of the spin die.

7. The method according to claim 1, wherein the spin die is positioned within the workpiece.

8. The method according to claim 1, wherein the workpiece is positioned within the spin die.

9. The method according to claim 1, wherein the workpiece is formed against the generally cylindrically shaped surface of the spin die.

10. The method according to claim 1, further comprising forming a mating flange at either one or both of the longitudinal end portions of the workpiece by spinning the workpiece, and as the workpiece is spinning, expanding the either one or both of the end portions of the workpiece to form a generally annularly shaped mating flange portion extending generally transversely to the longitudinal central axis of the remainder of the workpiece.

11. The method according to claim 10, further comprising creating a hem section from the outer perimeter portion of the mating flange while the workpiece is spinning by forming the outer perimeter portion of the mating flange to extend away from the surface of the mating flange to overlie the corresponding end of the workpiece and to be disposed substantially concentrically to the longitudinal central axis of the workpiece.

12. The method according to claim 11, further comprising forming a return flange at either one or both longitudinal end portions of the workpiece by turning a portion of the hem section located distally from the mating flange over on itself.

* * * * *